US010377970B2

(12) United States Patent
Callahan et al.

(10) Patent No.: US 10,377,970 B2
(45) **Date of Patent: *Aug. 13, 2019**

(54) LAUNDRY ADDITIVE AND DRUM TREATMENT

(71) Applicant: Zero Odor Company, LLC., Alpharetta, GA (US)

(72) Inventors: Richard Alan Callahan, Isle La Motte, VT (US); Bhupendra Chandrashanker Trivedi, Lombard, IL (US)

(73) Assignee: Zero Odor Co., LLC, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/021,898

(22) Filed: Jun. 28, 2018

(65) Prior Publication Data

US 2018/0312780 A1 Nov. 1, 2018

Related U.S. Application Data

(63) Continuation of application No. 15/406,750, filed on Jan. 15, 2017, now Pat. No. 10,041,022, and a continuation of application No. 15/158,577, filed on May 18, 2016, now Pat. No. 9,556,404, and a continuation of application No. 14/574,774, filed on Dec. 18, 2014, now Pat. No. 9,353,333.

(51) Int. Cl.

| | |
|---|---|
| ***C11D 1/00*** | (2006.01) |
| ***B08B 3/04*** | (2006.01) |
| ***C11D 3/20*** | (2006.01) |
| ***C11D 3/00*** | (2006.01) |
| ***C11D 3/22*** | (2006.01) |
| ***C11D 1/02*** | (2006.01) |
| ***C11D 11/00*** | (2006.01) |

(52) U.S. Cl.
CPC ..... *C11D 3/2086* (2013.01); *C11D 1/02* (2013.01); *C11D 3/0068* (2013.01); *C11D 3/225* (2013.01); *C11D 3/226* (2013.01); *C11D 11/0017* (2013.01)

(58) Field of Classification Search
CPC ..... C11D 1/00; C11D 3/2075; C11D 3/225; C11D 7/265; B08B 3/04
See application file for complete search history.

(56) References Cited

U.S. PATENT DOCUMENTS

| | | | | |
|---|---|---|---|---|
| 9,353,333 | B1 * | 5/2016 | Callahan | C11D 3/2086 |
| 9,556,404 | B2 * | 1/2017 | Callahan | C11D 3/2086 |
| 10,041,022 | B2 * | 8/2018 | Callahan | C11D 3/2086 |
| 2007/0049511 | A1 * | 3/2007 | Lawshe | C11D 1/83 510/424 |

* cited by examiner

*Primary Examiner* — Brian P Mruk

(57) ABSTRACT

The present invention relates to a liquid laundry additive composition and method of use in washing laundry. Not only does the composition reduce laundry odors but it also reduces washing machine drum odor.

23 Claims, No Drawings

LAUNDRY ADDITIVE AND DRUM TREATMENT

The instant application is a continuation of U.S. patent application 15/406,750, filed Jan. 15, 2017, now U.S. Pat. No. 10,041,022, which is a continuation of U.S. patent application 15/158,577, filed May 18, 2016, now U.S. Pat. No. 9,556,404, which is a continuation of U.S. patent application 14/574,774, filed Dec. 18, 2014, now U.S. Pat. No. 9,353,333.

FIELD OF THE INVENTION

The present invention relates to a laundry additive composition and methods for its use in treating laundry and a washing machine drum.

BACKGROUND OF THE INVENTION

All publications referred to herein are specifically incorporated herein by reference in their entirety.

Laundry detergents and laundry additives are well known. Laundry detergents can include surfactants, builders, alkalis, anti-redeposition agents, optionally enzymes, bleaches, antimicrobials, softeners, fragrances, optical brighteners, preservatives, processing aids, foam regulators and corrosion inhibitors. Some laundry detergents optionally include malodor neutralizing agents. For example, US2007/0049511 A1 discloses a laundry detergent composition that comprises conventional additives such as cationic and amphoteric surfactants, an optical brightener, a coloring agent, a fragrance, an enzyme, a builder, an electrolyte, a UV absorber, a bleach, a chelating agent, a preservative, a redeposition inhibitor, a dye transfer inhibitor, a thickener, a crease control agent, a pearl luster agent, a fabric softener, and/or mixtures thereof. This detergent also includes, as a malodor neutralizing agent, metallic salts, with zinc ricinoleate being most preferred.

Laundry detergents are often satisfactory for use alone to wash laundry items. There are times when the detergent is not deemed adequate to clean the laundry items as desired. In such instances, a laundry additive can be added to reach the desired objective. For example, for removing stains, a bleach additive can be added. Or Extra fabric softeners or wrinkle removers can be added.

Laundry washing machines use various amounts of washing water to which detergent is added for washing laundry. A problem with some laundry washing machines is that after a number of uses with detergent and/or laundry additive(s), the inside (drum) of the washing machine develops an offensive odor. It is believed that the odor results from the development of microbials in the drums. To remedy this odor problem, a number of commercial washing machine cleaning products are available. For the most part, these products are based on strong oxidizing agents such as sodium hypochlorite and sodium percarbonate. Apparently due to the potential for these cleaners to harm fabrics being washed, the metal container (drum) and gaskets, most of these cleaning products recommend use in a separate wash/rinse cycle without any laundry or detergent present in the washing machine during the separate cycle.

Accordingly, laundry additives which treat laundry and which can also treat the washing machine drum for odor would be desirable.

SUMMARY OF THE INVENTION

The present invention relates to liquid laundry additive compositions and to their methods of use. According to an embodiment of the invention, the liquid laundry additive composition comprises:

a. zinc ricinoleate;

b. carboxyalkyl cellulose; and c. at least one surfactant, wherein the ratio of total surfactant to zinc ricinoleate, on a dry basis, is decreased without increasing the content of the zinc ricinoleate in the total formulation on a wet basis. It was unexpectedly found that by controlling the total amount of surfactant, on a dry basis, relative to the zinc ricinoleate, not only was the composition a superior laundry additive for removing odor from laundry, but the composition also reduced drum odor. This was unexpectedly accomplished without using an excessive amount of zinc ricinoleate on a wet basis. For example, known laundry detergents or laundry treatments disclose using zinc ricinoleate in amounts up to about 10% of the total composition on a wet basis. For example, US200701005745 A1 discloses a fabric softener comprising up to 5% zinc ricinoleate. This publication discloses a fabric softener comprising from about 0.01% to about 5% by weight of zinc ricinoleate and about 1.0% to about 90% by weight of a cationic surfactant. Thus, at the lower end of both ranges the ratio of total surfactant to zinc ricinoleate, on a dry basis, is 100:1, and at the upper end of the ranges it is 18:1. Using the end points at the preferred ranges of about 0.2% to about 1.0% for zinc ricinoleate and most preferred range of about 3% to about 15% for cationic surfactant, the ratio, on a dry basis, of total surfactant to zinc ricinoleate is 15:1 at both the lower end and the upper end. In the formulations exemplified in the table in paragraph [0070] of this publication, the dry basis ratio of surfactant (TEA Esterquat or Diamidoamine Quaternary Ammonium compound) to TegoSorb Conc. 50 (described as 50% active zinc ricinoleate by supplier Evonik Industries) varies from 15.87:1 to 55.6: 1. US20070049511 A1 discloses a laundry detergent composition that comprises from about 1.0% to about 10% by weight of a non-ionic surfactant, from about 1% to about 15% of an an-ionic surfactant, and from about 0.01% to about 3% by weight of zinc ricinoleate. Again, using the end points of these ranges, this reference discloses a ratio of total surfactant to zinc ricinoleate (an-ionic plus non-ionic surfactant), on a dry basis, of from about 8.3:1 to about 200:1. In the example formulation disclosed in paragraph [0137] on page 11 of this publication, the dry basis ratio of total active surfactant (Linear Alkyl Sulfonate, AES and Alcohol Ethoxyolate) to TegoSorb Conc. 50 is 58.8:1. WO2008/084460 discloses a fabric color restoration spray for laundry that comprises up to 10% zinc ricinoleate. According to one embodiment in accordance with the present invention, the liquid laundry additive comprises zinc ricinoleate in an amount of about 10% or less on a wet basis (includes liquid solvent) and the ratio of total surfactant to zinc ricinoleate, on a dry basis, is less than about 4:1.

According to one embodiment, the laundry additive is added to a laundry wash together with detergent, resulting in odor reduction/abatement of the laundry. The detergent and the additive can be pre-mixed before addition to the laundry or can be added separately or sequentially with regard to the detergent.

According to one embodiment, the laundry additive is added to a laundry wash together with detergent, resulting in both odor reduction/abatement of the laundry and, unexpectedly, odor reduction/abatement of the drum. This result was unexpected because the amount of zinc ricinoleate on a wet basis did not exceed normal amounts disclosed in prior art formulations.

DETAILED DESCRIPTION OF THE INVENTION

All publications, patents and patent applications cited herein, whether supra or infra, are hereby incorporated herein by reference in their entirety to the same extent as if each individual publication, patent or patent application was specifically and individually indicated to be incorporated herein by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

It noted that, as used in this specification and the appended claims, the singular forms "a," "an" and "the" include plural referents unless the content clearly dictates otherwise. Unless otherwise expressly indicated herein, all amounts are based on weight. "Dry basis" means amounts specified in the absence of liquid carrier or water. "Wet basis" means amount as specified including liquid carrier or water. "Pourable" means a composition which is liquid and can be poured at temperatures above 40 degrees Fahrenheit. "Biocide" means an agent that inhibits the growth of microorganisms, or functions as a preservative to increase liquid product shelf life at the usage levels illustrated herein, and includes antimicrobials, fungicides and algicides. "Essentially free" allows for trace amounts of an item or amounts that do not materially affect the basic and novel characteristic(s)" of the invention disclosed herein. "Total surfactant" means the sum total, on a weight basis, of all surfactants in the composition. For example, Flexisorb® OD 120ZnR from Innovative Chemical Technologies, Inc. contains 1.4000 weight % anionic surfactant which surfactant is to be included in determining the total surfactant in a composition.

According to one embodiment, a liquid laundry additive comprises:

a. zinc ricinoleate;
b. carboxyalkyl cellulose; and
c. at least one surfactant;

wherein the zinc ricinoleate is present, on a wet basis, in an amount of about 10% or less, the ratio of total surfactant to zinc ricinoleate, on a dry basis, is less than about 4:1, and the additive is pourable. The composition can comprise a solvent (carrier). The preferred solvent is water.

According to one embodiment, a liquid laundry additive comprises:

a. zinc ricinoleate;
b. carboxyalkyl cellulose; and
c. at least one surfactant;

wherein the zinc ricinoleate is present, on a wet basis, in an amount of about 7% or less, the ratio of total surfactant to zinc ricinoleate, on a dry basis, is less than about 2:1, and the additive is pourable.

According to another embodiment, a liquid laundry additive comprises:

a. zinc ricinoleate;
b. carboxyalkyl cellulose; and
c. surfactant;

wherein the zinc ricinoleate is present, on a wet basis, in an amount of about 5% or less, the ratio of total surfactant to zinc ricinoleate, on a dry basis, is less than about 1:1, and the additive is pourable.

In accordance with another embodiment, a method for treating laundry in a washing machine comprises adding to the washing machine in combination:

a. laundry to be treated;
b. detergent; and
c. liquid laundry additive comprising:
   i. zinc ricinoleate;
   ii. carboxyalkyl cellulose; and
   iii. at least one surfactant;

wherein the zinc ricinoleate, on a wet basis, is about 10% or less of the liquid laundry additive, the ratio of total surfactant to zinc ricinoleate, on a dry basis, is less than about 4:1, and the additive is pourable. It is understood that water is also used in the washing machine.

Detergents are well known in the art for cleaning laundry items and typically include many of the following components:

a. surfactants for penetrating and wetting fabric, loosening soil, and emulsifying soils to keep them suspended in the wash solution;
b. builders for enhancing the action of surfactants by, for example, softening the water, helping to disperse soils and prevent their redeposition out of solution, and assisting in dissolving oil-based soils;
c. alkalis to raise the pH of wash water;
d. anti-redeposition agents to prevent dislodged soils from being redeposited;
e. enzymes to effect stain removal and provide color and fabric care;
f. active bleaches to improve fabric whiteness and brightness;
g. antimicrobial agents to hygienically clean fabrics;
h. fabric softeners to impart softness, reduce static electricity and reduce crinkling;
i. fragrances to neutralize odor in both the detergent chemicals and the soils in the laundry wash;
j. optical brighteners to enhance the light reflected from washed fabric to make the fabric look whiter and brighter;
k. preservatives to prevent detergent spoilage during storage;
l. solubizers to help maintain the pouring characteristics of liquid detergent;
m. processing aids to maintain the physical characteristics of laundry detergents during process, storage and use;
n. foam regulators to inhibit the formation of suds during washing; and
o. corrosion inhibitors to inhibit corrosion of metallic parts in the washing machine.

The laundry, detergent and additive can be added in any desired order, either sequentially or simultaneously. Alternatively, they can be mixed before adding to the wash. For example, the laundry to be treated can be added first to the washing machine followed by addition of either one of detergent or additive, or followed by simultaneous addition of detergent and additive.

In accordance with another embodiment, a method for treating laundry in a washing machine comprises adding to the washing machine in combination:

a. laundry to be treated;
b. detergent; and
c. liquid laundry additive comprising:
   i. zinc ricinoleate;
   ii. carboxyalkyl cellulose; and
   iii. at least one surfactant;

wherein the zinc ricinoleate is present, on a wet basis, in an amount of about 7% or less of the liquid laundry additive, the ratio of total surfactant to zinc ricinoleate is less than about 2:1 on a dry basis, and the liquid laundry additive is pourable.

In accordance with another embodiment, a method for treating laundry in a washing machine comprises adding to the washing machine in combination:

a. laundry to be treated;
b. detergent; and
c. liquid laundry additive comprising:
   i. zinc ricinoleate;
   ii. carboxyalkyl cellulose; and
   iii. at least one surfactant;

wherein the zinc ricinoleate is present, on a wet basis, in an amount of less than about 5% of the liquid laundry additive, the ratio of total surfactant to zinc ricinoleate is less than about 1:1 on a dry basis, and the liquid laundry additive is pourable.

In accordance with a further embodiment, a method for treating laundry washing machine drum odor, comprises:

a. adding to the washing machine a liquid laundry additive comprising:
   i. zinc ricinoleate;
   ii. carboxyalkyl cellulose; and
   iii. at least one surfactant;

wherein the zinc ricinoleate, on a wet basis, is 10% or less of the liquid laundry additive, the ratio of total surfactant to zinc ricinoleate is less than about 4:1 on a dry basis, and the additive is pourable. According to one embodiment, the washing machine contains laundry to be washed. According to another embodiment, detergent is also added in combination with the liquid laundry additive composition. The additive and detergent can be added in any order. For example, they can be added sequentially or combined before addition to the washing machine. The additive can further comprise biocide.

In accordance with another embodiment, a method for treating laundry washing machine drum odor, comprises:

a. adding to the washing machine a liquid laundry additive comprising:
   i. zinc ricinoleate;
   ii. carboxyalkyl cellulose; and
   iii. at least one surfactant wherein the zinc ricinoleate is present, on a wet basis, in an amount of about 7% or less of the liquid laundry additive, the ratio of total surfactant to zinc ricinoleate is less than about 2:1 on a dry basis, and the additive is pourable. According to one embodiment, the washing machine contains laundry to be washed. According to another embodiment, detergent is also added in combination with the liquid laundry additive composition. The additive and detergent can be added in any order. For example, they can be added sequentially or combined before addition to the washing machine. The additive can further comprise biocide.

In accordance with another embodiment, a method for treating laundry washing machine drum odor, comprises:

a. adding to the washing machine containing laundry to be washed, detergent and an additive comprising:
   i. zinc ricinoleate;
   ii. carboxyalkyl cellulose;
   iii. at least one surfactant;

wherein the zinc ricinoleate is present, on a wet basis, in an amount of about 5% or less of the additive, the ratio of total surfactant to zinc ricinoleate is less than about 1:1 on a dry basis, and the additive is pourable. According to one embodiment, the washing machine contains laundry to be washed. According to another embodiment, detergent is also added in combination with the liquid laundry additive composition. The additive and detergent can be added in any order. For example, they can be added sequentially or combined before addition to the washing machine. The additive can further comprise biocide.

According to another embodiment, a liquid laundry additive comprises:

a. zinc ricinoleate;
b. carboxyalkyl cellulose;
c. amphoteric surfactant;
d. optionally, nonionic surfactant;
e. anionic surfactant;
f. biocide;
g. fragrance; and
h. colorant;

wherein the zinc ricinoleate is present, on a wet basis, in an amount of less than about 10% and the ratio of total surfactant to zinc ricinoleate on a dry basis is less than about 4:1, and the additive is pourable. According to further embodiments, the zinc ricinoleate is present, on a wet basis, in an amount of less than 7% or 5%. According to other embodiments, the ratio of total surfactant to zinc ricinoleate is less than about 2:1 or less than about 1:1.

In accordance with one aspect, zinc ricinoleate is used effectively as a malodor neutralizing agent. For example, malodor neutralizing agent may comprise a water-soluble zinc ricinoleate. According to one embodiment, the zinc ricinoleate is present in the liquid laundry additive composition in an amount that is less than 10% on a wet basis. According to one embodiment, the zinc ricinoleate is present in an amount of less than about 7% of the additive on a wet basis. According to another embodiment, the zinc ricinoleate is present in an amount of less than about 5% of the additive on a wet basis. According to a further embodiment, the zinc ricinoleate is present in amount of from about 2% to about 10% on a wet basis. According to one embodiment, the zinc ricinoleate is present in an amount of about 3 to about 6%. This agent is described in detail in U.S. Pat. Nos. 4,968,496, 7,226,584 B2 and 8,318,806 B2. Zinc ricinoleate controls malodors selectively through a chemical binding of low molecular weight organic compounds containing the osmogene functional groups. On the other hand, zinc ricinoleate generally has no effect on carbonylic groups, such as aldehydes and ketones, which comprise typical fragrance and fragrance components. In one embodiment, the ratio of total surfactant to zinc ricinoleate, on a dry basis, is less than about 4:1. In another embodiment, the ratio of total surfactant to zinc ricinoleate, on a dry basis, is less than about 2:1. In a further embodiment, the ratio of total surfactant to zinc ricinoleate, on a dry basis, is less than about 1:1. According to another embodiment, the biocide comprises less than 1% of the additive composition.

Beneficially, zinc ricinoleate may stably complex with malodor molecules. The mode by which zinc ricinoleate complexes with malodors is similar to and can be compared to the iron binding and transport of oxygen in hemoglobinthe zinc acts as a catalyst to bind the malodor molecules, complexing it with the fatty acid side chains of the zinc ricinoleate molecule. In this way, the zinc ricinoleate neutralizes the malodors-that is, it reduces the level of undesirable malodors available for human perception.

Zinc ricinoleate molecules complex with one or more malodor molecules, depending on the size and shape of the malodor molecule(s). Once the complex is formed, it is a stable (irreversible) complex, that is, the malodor molecule will not be released from the zinc ricinoleate, even when the substrate dries. In comparison when malodor is treated with cyclodextrin, the cyclodextrin is best described as forming a cage-like structure around the malodor molecule which is reversible.

In one embodiment, the zinc ricinoleate is zinc ricinoleate, for example as that commercially available under the trade name Tego Sorb® conc. from Evonik Industries or Flexisorb® OD 120ZnR from Innovative Chemical Technologies, Inc.

In accordance with one aspect, a liquid laundry additive composition comprises carboxyalkyl cellulose, for example a $C_1$-$C_4$ carboxyalkyl cellulose. This component acts as a rheology modifier in the composition. In one embodiment, the carboxyalkyl cellulose is methylcarboxy cellulose, such as CMC 9H4F Cellulose Gum an Aqualon product available from Ashland Inc.

According to one embodiment, the liquid laundry additive further comprises at least one surfactant. Suitable surfactants for use therein include any known anionic, amphoteric and, optionally, nonionic surfactant(s).

In accordance with an embodiment of the present invention, a liquid laundry additive composition comprises anionic surfactant. Illustrative examples of anionic surfactants include alkali salts of fatty acids, alkyl ethoxysulfate acting as an anionic surfactant, sodium linear alkyl benzene sulfonate, those of the sulfonate type and of the sulfate type, such as $C_{9-13}$-alkylbenzenesulfonates, olefin sulfonates, i.e. mixtures of alkenesulfonates and hydroxyalkanesulfonates and also disulfonates, as are obtained, for example, from $C_{12-18}$-monoolefins having a terminal or internal double bond by sulfonating with gaseous sulfur trioxide followed by alkaline or acidic hydrolysis of the sulfonation products. Other examples are alkanesulfonates, which are obtained from $C_{12-18}$-alkanes, for example by sulfochlorination or sulfoxidation with subsequent hydrolysis or neutralization, respectively. Likewise suitable, in addition, are the esters of α-sulfo fatty acids (ester sulfonates), e.g. the α-sulfonated methyl esters of hydrogenated coconut, palm kernel or tallow fatty acids. Further exemplary anionic surfactants are sulfated fatty acid glycerol esters which are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glyceryl esters are sulfation products of saturated fatty acids of 6 to 22 carbon atoms, e.g., of capric acid, caprylic acid, capric acid, myristic acid, lauric acid, palmitic acid, stearic acid or behenic acid. Mixtures are included. Such surfactants are described, for example, in US20060223738 A1 and US20060229230 A1.

Examples of alk(en)yl sulfates are (including mixtures) the alkali metal salts, and especially the sodium salts, of the sulfuric monoesters of $C_{12}$-$C_{18}$ fatty alcohols, such as those of coconut fatty alcohol, tallow fatty alcohol, lauryl, myristyl, cetyl or stearyl alcohol, or of $C_{10}$-$C_{20}$ oxo alcohols, and those monoesters of secondary alcohols of this chain length. Also included are alk(en)yl sulfates of said chain length which contain a synthetic straight-chain alkyl radical prepared on a petrochemical basis, these sulfates possessing degradation properties similar to those of the corresponding compounds based on fatty-chemical raw materials, such as $C_{12}$-$C_{16}$-alkyl sulfates and $C_{12}$-$C_{15}$-alkyl sulfates, and also $C_{14}$-$C_{15}$ alkyl sulfates. Also included are 2,3-alkyl sulfates, sulfuric monoesters of the straight chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO which are known as fatty alcohol ether sulfates. Anionic surfactants further include the salts of alkylsulfosuccinic acid, which are also referred to as sulfosuccinates or as sulfosuccinic esters and which constitute the monoesters and/or diesters of sulfosuccinic acid with alcohols, such as fatty alcohols and ethoxylated fatty alcohols. Sulfosuccinates comprise $C_{8-18}$ fatty alcohol radicals or mixtures thereof, such as sulfosuccinates containing a fatty alcohol radical derived from ethoxylated fatty alcohols which themselves represent nonionic surfactants. Further examples in include sulfosuccinates whose fatty alcohol radicals are derived from ethoxylated fatty alcohols having a narrowed homolog distribution. Similarly, it is also possible to use alk(en)ylsuccinic acid containing 8 to 18 carbon atoms in the alk(en)yl chain, or salts thereof.

Further examples of anionic surfactants are soaps. Suitable soaps include fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids, and mixtures thereof. The anionic surfactants, including the soaps, may be present in the form of their sodium, potassium or ammonium salts and also as soluble salts of organic bases, such as mono-, di- or triethanolamine. The anionic surfactants can be in the form of their sodium or potassium salts, in particular in the form of the sodium salts and ammonium salts, such as the salts of organic bases, as for example of isopropylamine. A further class of anionic surfactants is the class of ether carboxylic acids which is obtainable by reacting fatty alcohol ethoxylates with sodium chloroacetate in the presence of basic catalysts.

In accordance with an embodiment of the present invention, a liquid laundry additive composition, optionally, comprises nonionic surfactant. Classes of nonionic surfactants include alcohols, alkanolamides, amine oxides, esters, and ethers. Nonionic alcohols are, for example, hydroxy derivatives of long-chain $C_8$-$C_{18}$, alkane hydrocarbons, such as cetearyl alcohol, hydrogenated tallow alcohol, lanolin alcohols, alkanolamides, and the like. Alkanolamides contain at least one alkoxyl or one polyoxyethylene grouping and include alkanol-derived amides, such as acylamide DEA, N-alkyl pyrrolidone, palmamide MEA, peanutamide MIPA, and the like and ethoxylated amides, such as PEG-50 tallow amide. Amine oxides include alkylamine oxides, such as lauramine oxide; and acylamidopropyl morpholine oxides, such as cocamidopropylamine oxide; and the like. Esters include ethoxylated carboxylic acids, ethoxylated glycerides, glycol esters and derivatives thereof, monoglycerides, such as glyceryl myristate, glyceryl palmitate lactate, and the like; polyglyceryl esters, such as polyglyceryl-6-distearate, polyglyceryl-4 oleyl ether, and the like, polyhydric alcohol esters and ethers, such as methyl gluceth-20 sesquistearate, sucrose distearate; and the like; sorbitan/sorbitol esters, such as polysorbate-60, sorbitan sequiisostearate, and the like; and triesters of phosphoric acid, such as trideceth-3 phosphate, trioleth-8 phosphate, and the like. Ethers include ethoxylated alcohols, such as ceteareth-10, nonoxynol-9, and the like; ethoxylated lanolin, such as PEG-20 lanolin, PPG-12-PEG-65 lanolin oil, and the like; propoxylated POE ethers, such as meroxapol 314, poloxamer 122, PPG-5-ceteth-20, polyalkylene glycol including, for example, polyethylene glycol (PEG) and the like; and alkyl polyglycosides, such as lauryl glucose, and mixtures thereof.

More non-limiting examples of nonionic surfactants include alkyl ethoxylated surfactants, block copolymer surfactants, castor oil surfactants, sorbitan ester surfactants, polyethoxylated fatty alcohol surfactants, glycerol monofatty acid ester surfactants, polyethylene glycol fatty acid ester surfactants, and mixtures thereof. These nonionic surfactants are described in more detail in U.S. Patent Application Pub. No. US 2002/0011584 A1. Castor oil surfactants include polyoxyethylene castor oil ethers or polyoxyethylene hardened castor oil ethers, which are either partially or fully hydrogenated. Nonionic surfactants are exemplified in US20130034505 A1 and US20060258768 A1.

In accordance with an embodiment of the present invention, a liquid laundry additive composition comprises amphoteric surfactant. Exemplary non-limiting nonionic surfactants are illustrated in US20070089244 A1 and include amine oxides, alkylamidoalkylamines, alkyl-substituted amino acids, acylated amino acids alkoxylated, preferably ethoxylated or ethoxylated and propoxylated, fatty acid alkyl esters, preferably having 1 to 4 carbon atoms in the alkyl chain, especially fatty acid methyl esters. Further suitable surfactants include those known as "gemini surfactants". This term is used generally to refer to those compounds which possess two hydrophilic and two hydrophobic groups per molecule. These groups are generally separated from one another by what is known as a spacer. This spacer is generally a carbon chain, which should be long enough to keep the hydrophilic groups at a distance sufficient to allow them to act independently of one another. Surfactants of this kind are generally notable for an unusually low critical micelle concentration and the ability to reduce greatly the surface tension of water. In exceptional cases, however, the expression gemini surfactants is used to embrace not only dimeric but also trimeric surfactants. Examples of gemini surfactants are sulfated hydroxy mixed ethers, dimer alcohol bis- and trimer alcohol tris-sulfates and ether sulfates. Tipped dimeric and trimeric mixed ethers are notable in particular for their bi- and multifunctionality. However, gemini-polyhydroxy fatty acid amides and polypolyhydroxy fatty acid amides are also examples. Further examples of amphoteric surfactants are illustrated in US20070049511 A1 and include the alkylbetaines of the formula (Ia), the alkylamidobetaines of the formula (Ib), the sulfobetaines of the formula (Ic) and the amidosulfobetaines of the formula (Id), $$R^1—N^+(CH_3)_2—CH_2COOR^1— \quad (Ia)$$

$$CO—NH—(CH_2)_3—N^+(CH_3)_2—CH_2COOR^1— \quad (Ib)$$

$$N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which $R^1$ is a saturated or unsaturated $C_{6-22}$-alkyl radical, a $C_{8-18}$-alkyl radical, or a saturated $C_{10-16}$-alkyl radical, for example a saturated $C_{12-14}$-alkyl radical, and mixtures thereof.

Illustrative Examples of suitable betaines and sulfobetaines are the following compounds named according to INCI: Almondamidopropyl Betaine, Apricotamidopropyl Betaine, Avocadamidopropyl Betaine, Babassuamidopropyl Betaine, Behenamidopropyl Betaine, Behenyl Betaine, Betaine, Canolamidopropyl Betaine, Capryl/Capramidopropyl Betaine, Carnitine, Cetyl Betaine, Cocamidoethyl Betaine, Cocamidopropyl Betaine, Cocamidopropyl Hydroxysultaine, Coco-Betaine, Coco-Hydroxysultaine, Coco/Oleamidopropyl Betaine, Coco-Sultaine, Decyl Betaine, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl PG-Betaine, Erucamidopropyl Hydroxysultaine, Hydrogenated Tallow Betaine, Isostearamidopropyl Betaine, Lauramidopropyl Betaine, Lauryl Betaine, Lauryl Hydroxysultaine, Lauryl Sultaine, Milkamidopropyl Betaine, Minkamidopropyl Betaine, Myristamidopropyl Betaine, Myristyl Betaine, Oleamidopropyl Betaine, Oleamidopropyl Hydroxysultaine, Oleyl Betaine, Olivamidopropyl Betaine, Palmamidopropyl Betaine, Palmitamidopropyl Betaine, Palmitoyl Camitine, Palm Kernelamiodopropyl Betaine, Polytetrafluoroethylene Acetoxypropyl Betaine, Ricinoleamidopropyl Betaine, Sesamidopropyl Betaine, Soyamidopropyl Betaine, Stearamidopropyl Betaine, Stearyl Betaine, allowamidopropyl Betaine, Tallowamidopropyl Hydroxysultaine, Tallow Betaine, Tallow Dihydroxyethyl Betaine, Undecylenamidopropyl Betaine and Wheat Germamidopropyl Betaine, and mixtures thereof.

Further examples of amphoteric surfactants, illustrated in US20070054829 A1, are from the group of alkyl acrylamide/acrylic acid copolymers, of alkyl acrylamide/methacrylic acid copolymers, of alkyl acrylamide/methyl methacrylic acid copolymers, of alkyl acrylamide/acrylic acid/alkyl aminoalkyl(meth)acrylic acid copolymers, of alkyl acrylamide/methacrylic acid/alkyl aminoalkyl(meth)acrylic acid copolymers, of alkyl acrylamide/methyl methacrylic acid/alkyl aminoalkyl (meth)acrylic acid copolymers, of alkyl acrylamide/alkyl meth acrylate/alkyl aminoethylmethacrylate/alkyl methacrylate copolymers as well as the copolymers from unsaturated carboxylic acids, cationically derivatized unsaturated carboxylic acid, and polymers which, in addition to one or more anionic monomers, also comprise methacrylamidoalkyl trialkyl ammonium chloride and dimethyl(diallyl)ammonium chloride as cationic monomers, and mixtures thereof.

In accordance with an embodiment of the present invention, a liquid laundry additive comprises a biocide. At the dosage levels illustrated herein, tilhe biocide functions to stabilize the shelf life of the additive composition. Examples of biocides are illustrated in US20100162923 A1 such as carbendazim, chlorothalonil, 3-iodo-2-propynyl butyl carbamate (IPBC), 1,2-benzisothaiazolin-3-one (BIT), sodium omadine, zinc omadine, zinc oxide, tetrahydro-3,5-dimethyl-2H-1,3,5-thiadiazine-2-thione solution, 5-hydroxymethoxymethyl-1-AZA-3,7-dioxabicyclo[3.3.0]octane formaldehyde release type preservative, 2-n-octyl-4-isothiazolin-3-one, 1-(3-chloroallyl)-3,5,7-triaza-1-azoniaadamantane chloride. Various such biocides or fungicides are commercially available such as Mergal® brand products from Troy Chemical Company, Inc., Promex™ brand products from PromChem Ltd., Nuocide 960 Arch Zinc Omadine and Proxel GXL™ antimicrobial from Arch Chemicals, and mixtures thereof.

In accordance with an embodiment of the present invention, a liquid laundry additive composition comprises fragrance. Any known fragrance or mixtures thereof that adds a pleasant aroma to the composition is suitable for use. Non-limiting illustrative examples of fragrances, for example those illustrated in US20060223738 A1, are the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methyl phenylglycinate, allyl cyclohexylpropionate, styrallyl propionate and benzyl salicylate. The ethers include, for example, benzyl ethyl ether; the aldehydes include, for example, the linear alkanals having 8-18 carbon atoms, citral, citronellal, citronellyloxyacetaldehyde, cyclamen aldehyde, hydroxy citronellal, lilial and bourgeonal; the ketones include, for example, the ionones, a-isomethylionone and methyl cedryl ketone; the alcohols include anethole, citronellol, eugenol, geraniol, linalool, phenylethyl alcohol and terpineol; the hydrocarbons include primarily the terpenes such as limonene and pinene. Mixtures of fragrances which together produce a pleasing fragrance note can also be used. Such fragrance oils may also comprise natural odorant mixtures, as are obtainable from vegetable sources, for example pine oil, citrus oil, jasmine oil, patchouli oil, rose oil or ylang-ylang oil. Likewise are muscatel, sage oil, chamomile oil, clove oil, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

In another embodiment, the liquid laundry additive is essentially free of at least one of enzyme, bleach, organic solvent, siloxane, solids, citrate, polysaccharide, cationic surfactant and isoprenoid. In a further embodiment, the liquid laundry additive is additionally or alternatively essentially free of at least one of silicone and cyclodextrin.

According to one embodiment, a laundry care article comprises a pour bottle containing the liquid laundry additive. According to another embodiment, the pour bottle is plastic, preferably a plastic squeeze bottle.

According to one embodiment, the liquid laundry additive, whether being used to treat laundry in a washing machine and/or treating washing machine drum odor, is added in an amount effective for the purpose. For example, the additive can be added for either purpose in an amount of at least about 1, 2, 3 or 4 ounces. It is believed that there is no upper limit for the amount added; however, from a cost-performance basis the additive can be added in amounts of up to about 6, 7, 8, 9 or even 10 ounces.

EXAMPLES

Following is a non-limiting illustrative example of liquid laundry detergent composition made in accordance with the teachings of this invention.

| Component | Weight % |
|---|---|
| Deionized water | 78.1471 |
| Promex Clear[1] | 0.1000 |
| CMC 9HF Cellulose gum[2] | 0.6000 |
| Flexisurf LDP[3] | 1.0000 |
| Green Ordenone[4] | 0.1000 |
| Flexisorb OD 120ZnR[5] | 20.0000 |
| Water (12.0000 wt. %) | |
| zinc ricinoleate (4.0000 wt. %) | |
| glycols (2.6000 wt. %) | |
| anionic surfactant (1.4000 wt. %) | |

-continued

| Component | Weight % |
|---|---|
| Fresh & Clean WS 119U52[6] | 0.0500 |
| Key acid brilliant blue[7] | 0.0029 |

[1]PromChem Ltd.
[2]Aqualon Product Manufactured by Ashland, Inc.
[3]Innovative Chemical Technologies, Inc.
[4]Belle Aire Fragrances
[5]Innovative Chemical Technologies, Inc.
[6]Flavors & Fragrances Specialties, Inc.
[7]Keystone, Inc.

Six bath towels were washed in a front load washing machine with Tide® brand laundry detergent alone, added according to the label instructions and then left overnight. When the washing machine was opened the next day to remove the towels, a noticeable objectionable (musty) odor was quite evident from both the towels and the washing machine drum upon removal of the towels therefrom. A liquid laundry additive composition according to the above formulation was then added in an amount of about 4 ounces and the towels without detergent were sent through a normal wash cycle. Upon completion of the wash cycle, the towels were removed and the objectionable odor was gone; a fresh aroma was detected. The odor was no longer present in the washing machine drum.

A quart sized glass jar with a round hinged metal lid, polymer lid gasket and closure clasp, to which a 3 inch square by ⅛ inch thick piece of silicone rubber to simulate a washing machine gasket, was used to simulate a small scale washing machine "test drum". The premise was that the inert glass surface, the lid's gasket and clasped closure would simulate a washing machine cycle on bench-top scale.

To create a silage odor in two "test drums", each was charged with about a quarter cup of fresh dry hay and sufficient water to substantially wet the rubber and hay. The lid clasps were then snapped shut forcing the polymer gaskets against the "test drum" opening to create a seal. Under these condition microbes present in the hay convert the hay to silage which has a distinct volatile odor profile.

The "test drums" were allowed to stand sealed for three weeks. Upon opening both "test drums" a noticeable silage odor was detected. The "test drums" were emptied and then washed with detergent simulating a wash cycle. After drying both "test drums" still retained detectable silage odor.

One "test drum" was then dosed with two ounces of Zero Odor laundry additive and about 12 ounces of fresh warm water. The "test drum" was resealed and vigorously agitated by manual shaking for about five minutes. After the dosed "test drum" was emptied of its contents it was rinsed with fresh warm water simulating a wash cycle. Afterward the dry "test drum" had no detectable odor of any kind whatsoever.

The invention claimed is:

1. A liquid laundry additive comprising:

a. zinc ricinoleate;

b. carboxyalkyl cellulose; and c. at least one surfactant;

wherein the zinc ricinoleate is present, on a wet basis, in an amount of about 10% or less, the ratio of total surfactant to zinc ricinoleate, on a dry basis, is less than about 1.4:1, and the additive is pourable.

2. The liquid laundry additive of claim 1, wherein the surfactant comprises an amphoteric surfactant, an anionic surfactant, and, optionally, a nonionic surfactant.

3. The liquid laundry additive of claim 1, further comprising a biocide.

4. The liquid laundry additive of claim 1, wherein the carboxyalkyl cellulose comprises carboxymethyl cellulose.

5. The liquid laundry additive of claim 1, wherein the additive has a pH greater than 7.

6. The liquid laundry additive of claim 5, wherein the additive has a pH of at least about 8.5.

7. The liquid laundry additive of claim 1, which is essentially free of enzyme bleach, organic solvent, siloxane, solids, citrate, polysaccharide, and isoprenoid.

8. The liquid laundry additive of claim 1, which is essentially free of silicone and cyclodextrin.

9. The liquid laundry additive of claim 1, wherein, the zinc ricinoleate is present, on a wet basis, in an amount of about 7% or less.

10. A method for treating laundry in a washing machine comprising adding to the washing machine in combination:

a. laundry to be treated;

b. detergent; and c. liquid laundry additive comprising:

i. zinc ricinoleate;

ii. carboxyalkyl cellulose; and iii. at least one surfactant;

wherein the amount of zinc ricinoleate, on a wet basis, is about 10% or less of the liquid laundry additive, the ratio of total surfactant to zinc ricinoleate, on a dry basis, is less than about 1.4:1, and the additive is pourable.

11. The method of claim 10, wherein b. and c. are added separately.

12. The method of claim 10, wherein b. and c. are mixed before adding to the laundry.

13. The method of claim 10, wherein the amount of zinc ricinoleate, on a wet basis, is about 7% or less of the liquid laundry additive.

14. A method for treating laundry washing machine drum odor, comprising:

a. adding to the washing machine a liquid laundry additive comprising:

i. zinc ricinoleate;

ii. carboxyalkyl cellulose; and iii. at least one surfactant;

wherein the zinc ricinoleate, on a wet basis, is 10% or less of the liquid laundry additive, the ratio of total surfactant to zinc ricinoleate is less than about 1.4:1 on a dry basis, and the additive is pourable.

15. The method of claim 14, wherein the additive further comprises a biocide.

16. A method according to claim 14, wherein laundry detergent is also added.

17. A method according to claim 14, wherein the washing machine contains laundry to be washed.

18. A liquid laundry additive comprising:

a. zinc ricinoleate;

b. carboxyalkyl cellulose;

c. amphoteric surfactant;

d. anionic surfactant;

e. biocide;

f. fragrance; and g. colorant;

wherein the zinc ricinoleate is present, on a wet basis, in an amount about 10% or less, the ratio of total surfactant to zinc ricinoleate is less than about 1.4:1 on a dry basis, and the additive is pourable and essentially free of enzyme.

19. The liquid laundry additive of claim 1, comprising an aqueous solvent.

20. The method of claim 10, wherein the additive is essentially free of enzyme and comprises an aqueous solvent.

21. The method of claim 14, wherein the additive comprises an aqueous solvent.

22. A laundry care article comprising a pour bottle containing the liquid laundry additive of claim 1.

23. The laundry care article of claim 22, wherein the pour bottle is a plastic squeeze bottle.

* * * * *